US006540434B1

(12) United States Patent
Hotchkin

(10) Patent No.: US 6,540,434 B1
(45) Date of Patent: Apr. 1, 2003

(54) SHOCK ABSORBING MEMBER

(76) Inventor: Darren John Hotchkin, Phoenix Street, Warragul Victoria 3820 (AU)

( * ) Notice: Subject to any disclaimer, the term of this patent is extended or adjusted under 35 U.S.C. 154(b) by 0 days.

(21) Appl. No.: 09/446,776

(22) PCT Filed: Jun. 29, 1998

(86) PCT No.: PCT/AU98/00496

§ 371 (c)(1),
(2), (4) Date: May 19, 2000

(87) PCT Pub. No.: WO99/00550

PCT Pub. Date: Jan. 7, 1999

(30) Foreign Application Priority Data

Jun. 27, 1997 (AU) ..... P0 7601

(51) Int. Cl.[7] ..... G01F 15/00
(52) U.S. Cl. ..... 404/6; 404/9; 52/309.2
(58) Field of Search ..... 156/245; 524/924, 524/927, 928; 404/6, 9; 256/13.1; 52/309.2

(56) References Cited

U.S. PATENT DOCUMENTS 1,683,864 A * 9/1928 Campbell ..... 524/928
3,602,109 A * 8/1971 Harrington ..... 256/13.1
4,564,310 A * 1/1986 Thelen et al. ..... 404/31
5,020,175 A * 6/1991 Kirkpatrick et al. ..... 5/448
5,023,287 A * 6/1991 Evans et al. ..... 524/255
5,122,008 A 6/1992 Drews
5,151,230 A * 9/1992 Damberg ..... 264/83
5,316,708 A 5/1994 Drews
5,336,016 A 8/1994 Baatz
5,360,286 A * 11/1994 Russell ..... 404/6
5,429,449 A * 7/1995 Baatz ..... 404/6
5,704,178 A * 1/1998 Ciao ..... 52/309.1
5,918,332 A * 7/1999 Dees ..... 5/639

FOREIGN PATENT DOCUMENTS

| | | |
|---|---|---|
| AU | 23304/95 | 1/1997 |
| CA | 2015765 | 10/1991 |
| DE | 33 34927 A1 | 5/1984 |
| GB | 1553306 | 9/1979 |
| GB | 2221941 | 2/1990 |
| JP | 07127025 A | 5/1995 |

* cited by examiner

*Primary Examiner*—Thomas B. Will
*Assistant Examiner*—Raymond Addie
(74) *Attorney, Agent, or Firm*—Michael Best & Friedrich LLP

(57) ABSTRACT

A shock absorbing member that is particularly suitable for use as a part of a crash barrier system for motor vehicles is disclosed. The shock absorbing member includes a matrix formed from granulated rubber bonded together by a glue.

6 Claims, 1 Drawing Sheet

SHOCK ABSORBING MEMBER

The present invention relates to a shock absorbing member.

The present invention relates particularly, although by no means exclusively, to a shock absorbing member for absorbing impact energy of a motor vehicle.

The present invention also relates particularly, although by no means exclusively, to a crash barrier system for motor vehicles based on the shock absorbing member.

Conventional crash barrier systems for motor vehicles include guard rails, chains, or other substantially rigid barriers which are designed to absorb impact energy of motor vehicles. Conventional crash barrier systems also include arrays of air bags and foam blocks enclosed by guard rails which form less rigid barriers which nevertheless are capable of absorbing impact energy of motor vehicles. However, a common problem with these known systems is that they are not resilient and thus must be repaired or replaced altogether if contacted by a motor vehicle.

An object of the present invention is to provide a crash barrier system based on shock absorbing members that are resilient that alleviates the disadvantage of the known crash barrier systems described in the preceding paragraph.

Figure 1:
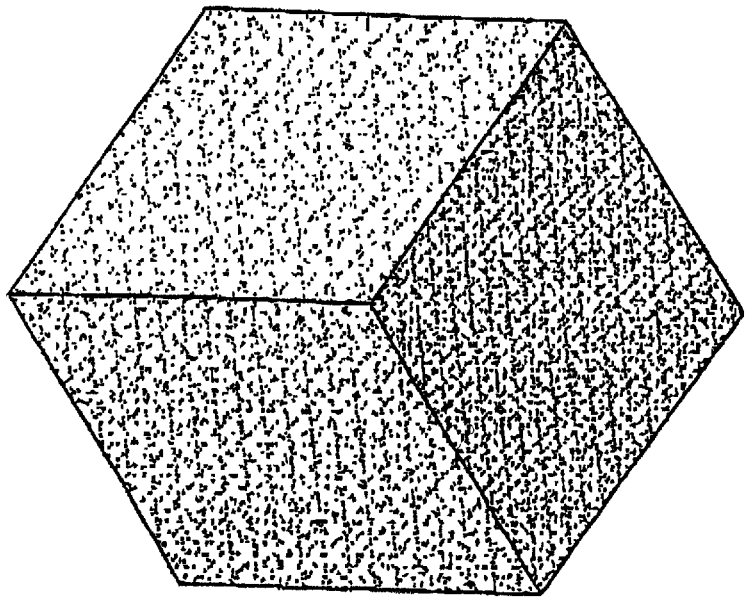
FIG. 1 is a 1$^{st}$ embodiment of the present invention.

According to the present invention there is provided a shock absorbing member formed from a granulated rubber bonded together by a glue.

The rubber and the glue form a continuous matrix. The matrix makes up part of the volume occupied by the member, and air makes up the remainder of the volume.

The applicant has found in crash tests of motor vehicles that the shock absorbing member is capable of absorbing substantial impact energy by compressing in response to motor vehicle impact and, in view of the resilience of the rubber, recovers to its original shape after a motor vehicle impact.

The granulated rubber may be made by any suitable means.

Preferably the granulated rubber comprises granulated tyres.

Preferably the ratio of rubber to glue by volume is 3:1 to 5:1.

More preferably the ratio of rubber to glue by volume is 4:1.

The glue may be any suitable glue.

Preferably the glue is a polyurethane-based glue.

Preferably the member includes 30–80% by volume air.

More preferably the member includes 40–70 vol. % air.

Typically the member includes 55–65 vol. % air.

Preferably the member is formed in a mould without applying pressure to form the member.

Preferably the rubber and the glue are pre-mixed in the required proportions, delivered to the mould, and allowed to air cure.

The granulated rubber may be of any suitable shape, particle size, and particle size distribution.

By way of example, the granulated rubber may be fibrous, ie have a relatively high aspect ratio, or may have relatively uniform dimensions.

The shape, size, and size distribution of the particles of granulated rubber, the ratio of rubber to glue, and the vol. % air in the member, may be varied as required to obtain different combinations of energy absorption and resilience in the member.

A preferred use of the shock absorbing member is to absorb impact energy of a motor vehicle.

In this connection, according to the present invention there is also provided a motor vehicle crash barrier system which includes one or more than one of the shock absorbing member.

Preferably the crash barrier system includes a means for locating the or each member in relation to a ground surface.

In a situation where the purpose of the crash barrier system is to protect a motor vehicle from direct impact with a structure, such as a post, preferably the locating means includes a pair of guide rails which extend along opposite sides of the or each member and a means for securing the guide rails to the ground surface. The purpose of the guide rails is to confine the members to compress, in response to vehicle impact, towards the structure thereby decelerating the vehicle as it moves towards the structure.

Preferably, the crash barrier system includes a guard rail or other suitable deflection barrier.

The crash barrier system may include any suitable arrangement of a plurality of the shock absorbing member.

The crash barrier system may comprise a selection of different-shaped shock absorbing members.

It is preferred that the shape of the shock absorbing member be suited for a crash barrier system for motor vehicles.

As noted above, the shape, size, and the size distribution of the particles of granulated rubber, the relative proportions of the rubber granules and the glue, and the amount of air, may be varied as required to obtain different combinations of resilience and energy absorption in the shock absorbing member.

This is an important feature for a motor vehicle crash barrier system formed from a plurality of the shock absorbing member, since in many instances it is desirable that shock absorbing members have a range of combinations of resilience and energy absorption depending on a range of factors including, but not limited to:

(i) the positions of the shock absorbing members in the crash barrier system:

(ii) the vehicle speed limit on the roadway; and (iii) the weights of the vehicles that may collide with each barrier system.

By way of example, in a preferred crash barrier system, the shock absorbing members are selected and arranged so that the resilience of the members decreases with distance from the roadway. The purpose of such an arrangement is to progressively absorb the impact energy of a motor vehicle without bringing the vehicle to an abrupt stand-still.

According to the present invention there is provided a method of forming the shock absorbing member described above which includes the steps of:

(a) supplying a mixture of a granulated rubber and a glue to a mould; and (b) without applying pressure to the mould, allowing the mixture to cure to form the member.

Figure 2:
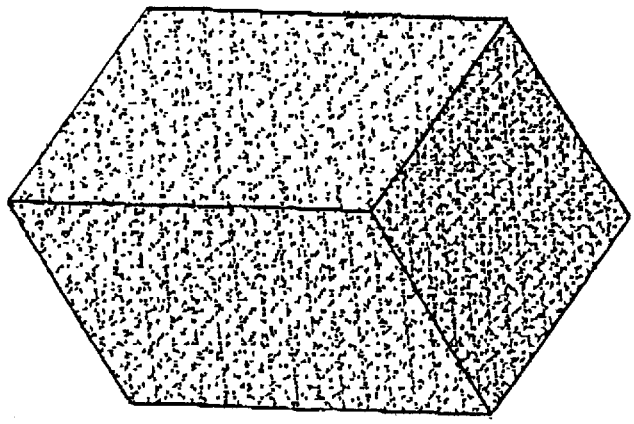
FIG. 2 is a 2nd embodiment of the present invention.
Figure 3:
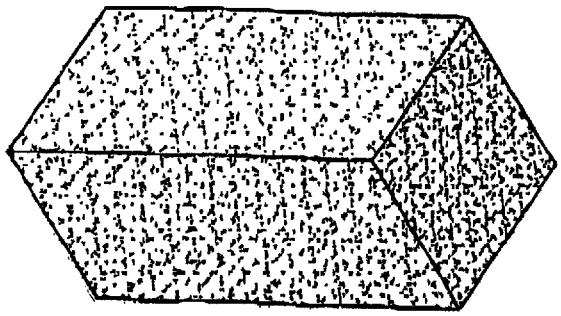
FIG. 3 is a 3$^{rd}$ embodiment of the present invention.

The present invention is described further with reference to accompanying FIGS. 1 to 3, which are perspective views of three different sizes of motor vehicle crash barrier systems in accordance with the present invention. The crash barrier system shown in FIG. 1 is a cubic block that may be, for example, one meter by one meter. The crash barrier system shown in FIG. 2 is a rectangular block that may be, for example, 700 mm by 700 mm by 1 meter. The crash barrier system shown in FIG. 3 is a rectangular block that may be, for example, 500 mm by 500 mm by 1 meter.

The applicant arranged for a series of crash tests to be carried out by an independent laboratory on a series of samples of a preferred shock absorbing member in accordance with the present invention.

The samples tested were in block form and, specifically, were 700 mm long/700 mm wide/1 m high, 500 mm long/500 mm wide/1 m high, and 1 m long/1 m wide/1 m high. The samples were moulded with rubber: polyurethane glue ratios of 4:1 and 5:1 by volume. The samples included 55–60 vol. % air.

In most cases the samples were positioned against a rigid barrier. In a limited number of cases the samples were spaced between 400 mm and 1 m in front of the barrier.

A vehicle was driven into each sample at a preset speed and measurements were made of parameters including the deceleration of the vehicle after impact and the compression of the samples. The impact speeds selected were 15, 20, 25, and 30 km/hr.

The results are set out in the following table.

| Block Size | Make | Impact Vel (km/hr | Contact Area ($M^2$) | Deceleration Centre (g's) | Compression (mm) | Max Rebound Vel (km/hr) |
|---|---|---|---|---|---|---|
| 700 × 700 | 4:1 U | 15 | 0.595 | 7.37 (65.9) | 230 (93.1) | 6.0 (165.4) |
| 700 × 700 | 4:1 U | 15 | 0.595 | 7.32 (55.0) | 240 (96.5) | 5.6 (165.3) |
| 700 × 700 | 4:1 U | 20 | 0.595 | 10.64 (54.9) | 290 (84.3) | 10.4 (169.1) |
| 700 × 700 | 4:1 U | 25 | 0.595 | 15.65 (60.4) | 350 (78.8) | 12.5 (162.2) |
| 700 × 700 | 4:1 U | 30 | 0.595 | 21.74 (64.9) | 400 (73.6) | 13.8 (145.7) |
| 700 × 700 | 4:1 U | 15 | 0.595 | 6.25 (75.4) | 250 (102.6) | 5.9 (178.3) |
| 700 × 700 | 5:1 U | 25 | 0.595 | 14.32 (69.0) | 380 (88.2) | 10.2 (171.0) |

-continued

| Block Size | Make | Impact Vel (km/hr | Contact Area ($M^2$) | Deceleration Centre (g's) | Compression (mm) | Max Rebound Vel (km/hr) |
|---|---|---|---|---|---|---|
| 700 × 700 | 5:1 U | 25 | 0.595 | 16.72 (64.5) | 310 (71.9) | 12.9 (137.4) |
| 500 × 500 | 4:1 U | 15 | 0.425 | 8.70 (70.2) | 230 (89.0) | 7.8 (173.1) |
| 1000 × 1000 | 5:1 U | 30 | 0.850 | 14.71 (65.3) | 480 (95.8) | 14.9 (208.6) |
| 700 × 700 | 4:1 U | 30 | 0.385 | 15.94 (88.0) | 560 (102.5) | 14.9 (214.2) |
| 700 × 700 | 5:1 U | 30 | 0.385 | 16.80 (94.1) | 600 (105.8) | 15.3 (232.9) |

Note: The numbers in brackets ( ) represent the time after initial impact in milliseconds.

The results of the crash tests summarised in the table indicate that the shock absorbing member is an effective alternative to known crash barrier systems.

Many modifications may be made to the preferred embodiment described above without departing from the spirit and scope of the present invention.

What is claimed is:

1. A motor vehicle crash barrier system which includes one or more than one shock absorbing member formed from a granulated rubber bonded together by a glue, the member including (i) a continuous matrix of the rubber and the glue which occupies 20–70% of the volume of the member and (ii) air which occupies the remainder of the volume of the member, the member being formed by supplying a mixture of the granulated rubber and glue to a mold, and, without applying pressure to the mold, allowing the mixture to cure to form the member.

2. The system defined in claim 1, wherein the granulated rubber comprises granulated tires.

3. The system defined in claim 1, wherein the ratio of rubber to glue by volume is 3:1 to 5:1.

4. The member system defined in claim 3, wherein the ratio of rubber to glue by volume is 4:1.

5. The system defined in claim 1, wherein air occupies 40–70 vol. % of the member.

6. The system defined in claim 5, wherein air occupies 55–65 vol. % of the member.

* * * * *